US008028729B2

(12) United States Patent
Kaempf

(10) Patent No.: US 8,028,729 B2
(45) Date of Patent: Oct. 4, 2011

(54) CONNECTING SUBASSEMBLY FOR CONNECTING AN INITIAL CONTAINER AND A TARGET CONTAINER

(76) Inventor: Ralf Kaempf, Tettau (DE)

( * ) Notice: Subject to any disclaimer, the term of this patent is extended or adjusted under 35 U.S.C. 154(b) by 1226 days.

(21) Appl. No.: 11/657,711

(22) Filed: Jan. 24, 2007

(65) Prior Publication Data

US 2007/0181215 A1 Aug. 9, 2007

Related U.S. Application Data

(60) Provisional application No. 60/761,648, filed on Jan. 24, 2006, provisional application No. 60/816,758, filed on Jun. 27, 2006.

(30) Foreign Application Priority Data

Jan. 24, 2006 (DE) ..... 20 2006 001 319 U
Jun. 14, 2006 (DE) ..... 20 2006 009 585 U

(51) Int. Cl.
*B65B 1/04* (2006.01)

(52) U.S. Cl. ..... 141/353; 141/321; 251/149.6

(58) Field of Classification Search ..... 141/21, 141/290, 311 R, 321, 346, 351, 353, 354, 141/357; 251/149, 149.1, 149.6
See application file for complete search history.

(56) References Cited

U.S. PATENT DOCUMENTS 2,401,674 A 6/1946 Vizay
3,330,313 A 7/1967 Rosell
5,249,611 A 10/1993 Law
5,467,806 A 11/1995 Stricklin et al.
5,620,434 A * 4/1997 Brony ..... 604/406
5,694,991 A * 12/1997 Harris et al. ..... 141/346
6,325,099 B1 12/2001 Bunschoten et al.
6,397,902 B1 * 6/2002 Murphy ..... 141/59
6,478,058 B1 11/2002 Pears
7,013,936 B2 3/2006 Schliemann et al.
2003/0234061 A1 12/2003 Trippi, Jr.
2004/0025968 A1 * 2/2004 Allen ..... 141/351

(Continued)

FOREIGN PATENT DOCUMENTS

CH 47394 6/1910

(Continued)

OTHER PUBLICATIONS

English Language Abstract for FR-2303730A (1 page) (which corresponds to DE 7607714 U1).

(Continued)

*Primary Examiner* — Gregory Huson
*Assistant Examiner* — Jason Niesz
(74) *Attorney, Agent, or Firm* — Flynn, Thiel, Boutell & Tanis, P.C.

(57) ABSTRACT

The invention relates to a connecting subassembly for connecting an initial container and a target container.
According to the invention, the connecting subassembly has an outlet cylinder and a control cylinder, wherein the outlet cylinder and the control cylinder can be displaced relative to each other, and the outlet cylinder and the control cylinder are designed such that they can be displaced with respect to each other, in an operating position in which the connecting subassembly is connected to a target container, between a closed position, in which the control cylinder interrupts a flow path through the outlet opening of the outlet cylinder, and an open position, in which the control cylinder releases the flow path through the outlet opening of the outlet cylinder.
Use, for example, for motor vehicle fuels.

21 Claims, 10 Drawing Sheets

U.S. PATENT DOCUMENTS

Figure 1A:
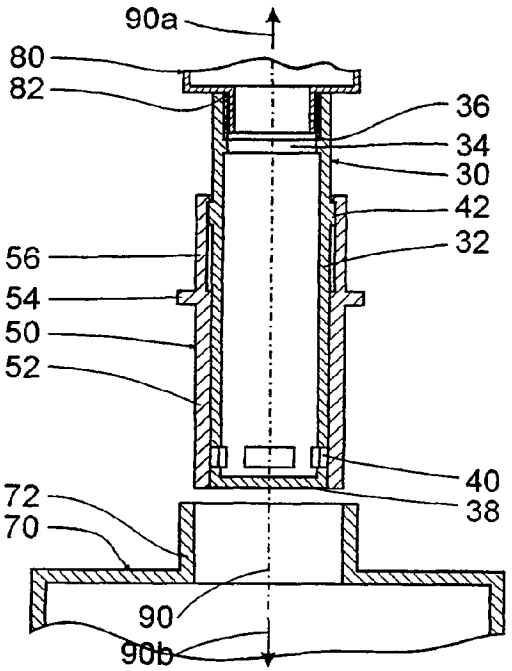

| | | | |
|---|---|---|---|
| 2004/0035895 | A1 | 2/2004 | Schliemann et al. |

FOREIGN PATENT DOCUMENTS

| | | | |
|---|---|---|---|
| CH | 47755 | | 8/1910 |
| DE | 389501 | | 2/1924 |
| DE | 839163 | | 5/1952 |
| DE | 1 475 664 | | 2/1969 |
| DE | 7419973 | | 10/1974 |
| DE | 7607714 | U1 | 8/1976 |
| DE | 84 21 305.1 | | 10/1984 |
| DE | 42 17 965 | C1 | 5/1993 |
| EP | 0 294 719 | | 12/1988 |
| WO | WO 00/76905 | A2 | 12/2000 |

OTHER PUBLICATIONS

English Language Abstract for AU-A-11818/76 (1 page) (which also corresponds to DE 7607714 U1).
German Patent Office Search Report dated Jun. 27, 2006 (4 pages).
German Patent Office Search Report dated Oct. 31, 2006) 4 pages).

* cited by examiner

CONNECTING SUBASSEMBLY FOR CONNECTING AN INITIAL CONTAINER AND A TARGET CONTAINER

This application claims the benefit of U.S. Provisional Application No. 60/816,758 filed Jun. 27, 2006, and also claims the benefit of U.S. Provisional Application No. 60/761,648 filed Jan. 24, 2006.

The invention relates to a connecting subassembly for connecting an initial container and a target container, in particular for topping up fuels in motor vehicles.

A connecting subassembly of this type permits the filling of the target container with a medium, such as a liquid or a small-grained, pourable material. The initial container and the target container are connected to each other by the connecting assembly in such a manner that, as far as possible, there should be no concern that any part of the medium will be lost. In particular, fuels of motor vehicles, in particular additives, in order to achieve low-polluting combustion, can be poured from a small, portable initial container into a target container built into the motor vehicle.

One simple possibility constitutes the connection by means of a tube fastened on both sides. A drawback here is that, depending in each case on the position of the initial container and of the target container with respect to each other, some of the medium may be lost when opening the initial container or when disconnecting the tube connection. This is a drawback in particular in the case of expensive or, for example, toxic media.

To pour a medium into the target container, a funnel may also be used as the starting container. A funnel of this type usually has, as the connecting subassembly, for fastening it to an extension piece of the target container, an external thread or a tubular outlet section, which is pushed into the extension piece of the target container. A drawback in this case is that, if medium remains in the funnel, said medium may escape when the funnel is disconnected from the target container, since, firstly, residues may flow out of the funnel and, secondly, the target container may overflow.

It is the object of the invention to provide a connecting subassembly which makes it possible to fill medium from an initial container into a target container without some of the medium being lost.

According to the invention, this is achieved by a connecting subassembly for connecting an initial container and a target container, wherein the connecting subassembly has an outlet cylinder with an open first end side, which can be connected to the initial container, with a second closed end side and with at least one outlet opening in a surface area, and also has a control cylinder surrounding the outlet cylinder in the region of the outlet opening, wherein, in an operating position, in which the connecting subassembly is connected to the target container, the outlet cylinder and the control cylinder are designed such that they can be displaced with respect to each other between a closed position, in which the control cylinder closes the outlet opening of the opening cylinder, and an open position, in which the control cylinder releases the outlet opening of the outlet cylinder.

The initial container and the target container serve to receive media, such as, in particular, liquids and small-grain and/or pourable substances. During initial filling, topping up or decanting into the target container, and for mixing multi-component media in the target container, the initial container may occasionally be connected to the target container by means of the connecting subassembly. In the context of this invention, target containers are understood as meaning, for example, tanks, canisters or else pipelines or tube lines for conveying the medium. In addition, funnels are also suitable as initial containers. Depending on the embodiment of the invention, the extension piece on the target container may be a simple opening or else a more complex extension piece, such as a section of pipe, with an external thread or part of a bayonet-type fastening. Instead of an open first end side of the outlet cylinder, at least one opening which can be brought into connection with the initial container may also be provided in the region of the first end side.

The outlet cylinder of the connecting subassembly is a hollow cylinder, which is connected to the initial container in such a manner that the medium of the initial container can flow through the first open end side into the outlet cylinder. In the closed position of the control cylinder, the outlet cylinder is otherwise outwardly sealed off such that the medium cannot escape. The at least one outlet opening located on the surface area is closed by means of the control cylinder, which is likewise designed as a hollow cylinder. For this purpose, the outlet cylinder and the control cylinder are designed in such a manner that the control cylinder bears with an inner surface, at least in the region of the outlet opening, against an outer surface of the outlet cylinder and/or the outlet opening is sealed off to the outside by means of additional sealing means, such as sealing lips. The outlet cylinder and the control cylinder preferably each has a circular cross section. However, other, for example polygonal, cross sections may also be expedient. The control cylinder does not have to completely surround the outlet cylinder but rather may, for example, also be slit longitudinally.

The control cylinder and the outlet cylinder can be displaced in relation to each other along a main access in such a manner that, after connection of the connecting subassembly to the target container, the outlet opening of the outlet cylinder can be opened, and in this open position, the medium can flow through the outlet cylinder from the initial container into the target container. After the filling operation is completed, the control cylinder and the outlet cylinder are again displaced in relation to each other such that the outlet opening is closed again by the control cylinder. The initial container can subsequently be disconnected from the target container without medium which has remained in the initial container or in the outlet cylinder being lost.

The at least one outlet opening can be adapted in terms of its size to the specific medium and the desired filling speed. Furthermore, the filling speed can also be controlled by the extent to which the control cylinder is displaced relative to the outlet cylinder.

The connecting subassembly can be connected to the initial container both as a single piece and also separately, and can be provided for permanent or temporary fastening to the initial container. In the case of a separate connecting subassembly, the fastening to the initial container by means of a plug-in, screw-type or bayonet-type fastening is expedient. In addition, a snap-fit connection is also possible. In order to connect the connecting subassembly to the target container, in particular plug-in, screw-type or bayonet-type fastenings are expedient. It may be expedient to provide seals both on the side of the initial container and on the side of the target container in order effectively to prevent an inadvertent emergence of the medium.

In a development of the invention, in the operating position, the control cylinder is arranged in a fixed position relative to an extension piece of the target container.

In this development, in the operating position, the outlet cylinder is displaced relative to the target container and the control cylinder, with the control cylinder remaining in a fixed position with respect to the target container. As a result, particularly simple designs can be realized, since it is not necessary here for the outlet cylinder, which is located on the inside, on the other side of the control cylinder, which is located on the outside, to rest on the extension piece of the target container and therefore to have to engage on the target container through the control cylinder or around the latter. Also, only the outlet cylinder and the control cylinder then have to be sealed off from each other.

In a development of the invention, the at least one outlet opening is arranged in such a manner that, in the operating position of the connecting subassembly and the open position of the control cylinder and of the outlet cylinder with respect to each other, it is located within the target container.

By this means, inadvertent spilling of medium during the disconnection of the connecting subassembly from the target container does not occur. After the outlet cylinder is displaced relative to the control cylinder into the closed position, the initial container can be removed together with the connecting subassembly from the target container, wherein no part of the medium that no longer fits into the target container can escape from the initial container and, if appropriate, at the same time the level in the target container drops because of removal of the outlet cylinder.

In one development, the control cylinder and the outlet cylinder are pressed against each other by a spring force which acts in the direction of the closing position.

In such an embodiment, the connecting subassembly can be transferred into its open position by, for example, manual application of a force opposed to the spring force. If this force ceases, the connecting subassembly returns into the closed position because of the prestressing of the spring force. This reduces the risk of the connecting subassembly being inadvertently removed from the target container in the open position. Furthermore, a metered filling of the target container is also possible in a simplified manner if the outlet cylinder and the control cylinder do not have to be drawn back manually into the closed position in order to end the media flow.

In a development of the invention, the connecting subassembly has at least one locking pawl, by means of which the displaceability of the control cylinder relative to the outlet cylinder can be blocked in a blocking position of the locking pawl.

In the blocking position, a displacement of the outlet cylinder and of the control cylinder with respect to each other is not possible or is only possible to the extent that medium cannot emerge from the outlet cylinder through the outlet opening. This ensures that an inadvertent opening of the outlet opening does not occur. The locking pawl provides a preferably interlocking connection between the outlet cylinder and the control cylinder for this purpose. It can be designed in such a manner that it is directly moved manually into the blocking position or a release position, or else can be indirectly actuated in that the connecting subassembly is brought into an operating position.

In a development of the invention, the at least one locking pawl is designed in such a manner that it is moved from the blocking position to a release position by the connecting subassembly being placed onto an extension piece of the target container.

In this development, an actuation of the locking pawl is triggered by connection of the connecting subassembly to the extension piece of the target container. Only as a result of this is said locking pawl brought into the release position, in which the outlet cylinder and the control cylinder can be displaced relative to each other into the open position. The open position therefore cannot be produced inadvertently before the operating position of the connecting subassembly on the extension piece of the target container is reached. The movement of the locking pawl into the release position can be obtained both by indirect or direct action of the extension piece and by manual relative movement of components of the connecting subassembly with respect to each other, for example by rotation of the bayonet ring of a bayonet-type fastening of the connecting subassembly.

In a development of the invention, the at least one locking pawl is provided between the control cylinder and an outer sleeve, wherein the outer sleeve, to fasten it to the extension piece of the target container, can be displaced relative to the control cylinder in such a manner that the locking pawl is tilted out of a blocking position into a release position.

In an embodiment of this type, the control cylinder and the outer sleeve can be displaced in relation to each other in an attachment direction. When the connecting subassembly is attached to the extension piece of the target container, in particular when the connecting subassembly is screwed on, the two components are displaced in relation to each other as soon as one of the components, preferably the control cylinder, bears against a shoulder on the extension-piece side. The relative displacement between control sleeve and outer sleeve that then occurs in the course of the further movement of the outer sleeve leads to a tilting of the at least one locking pawl, which is arranged between control sleeve and outer sleeve and is thereby pivoted out of a previous, blocking tilting state into a releasing tilting state and therefore permits a relative movement between outlet cylinder and control cylinder. A configuration of this type is simple to realize and provides a high degree of security, since there need not be any concern that the control cylinder and the outer sleeve will be inadvertently displaced. Configurations are particularly advantageous in which, in the non-attached state of the connecting subassembly, the control cylinder is difficult to access manually, or in which an additional spring is provided between the outer sleeve and the control cylinder and opposes an undesired relative displacement. The locking pawl may be, for example, of T-shaped design, with it then being possible for a tilting movement to take place by displacement of one of the outer ends of the T shape.

In a development of the invention, the at least one locking pawl is of L-shaped design and has a blocking limb and an actuating limb, wherein a proximal end of the actuating limb rests on a pivoting step of the control cylinder and, in the release position, a distal end of the actuating limb bears against an actuating step of the outer sleeve.

A locking pawl of this type constitutes a particularly simple configuration. In the blocking position, the blocking limb preferably extends in the direction of displacement of outlet cylinder and control cylinder with respect to each other. In this case, the blocking limb bears with its distal end against a shoulder surface of the outlet cylinder and with its proximal end against the pivoting step of the control cylinder. It thereby prevents a relative displacement between outlet cylinder and control cylinder and therefore a reaching of the open position being possible. If the outer sleeve is displaced toward the control cylinder, it uses the actuating step to grasp the distal end of the actuating limb, such that the latter is tilted, during the course of further displacement of the outer sleeve, about the pivoting step of the control cylinder, and therefore the blocking limb, which is connected integrally to the actuating limb, is thus also pivoted outwards in the region of the shoulder surface of the outlet cylinder. The release position, in which the outlet cylinder can be displaced toward the control cylinder, is therefore reached.

In a development of the invention, the at least one locking pawl is acted upon in the direction of the blocking position by a spring force.

As a result, the blocking pawl automatically passes back again into the blocking position, for example after the connection subassembly is removed from the extension piece of the target container. A manual movement of the locking pawl into its blocking position can be omitted as a result.

In a development of the invention, the connecting subassembly has at least two locking pawls which are arranged on the outer circumference of the control cylinder and are connected to each other by elastic intermediate elements oriented in the circumferential direction.

Configurations with four or more locking pawls preferably arranged uniformly on the circumference of the control cylinder are particularly advantageous. The plurality of locking pawls block the relative movement of the outlet cylinder and of the control cylinder particularly reliably and uniformly as a result. By means of the elastic intermediate elements, the locking pawls are pressed at all times in the direction of the blocking position by a spring force without a structurally more complicated construction with separate spring elements between the individual locking pawls and the control cylinder or the outer sleeve being required. The elastic intermediate elements can be formed, for example, by elastically expandable bands or else helical springs.

In a development of the invention, the locking pawls are together formed as a single piece from plastic, and the intermediate elements are designed as elastic plastic webs.

This constitutes a particularly cost-effective design which is simple to handle during installation. The single-piece plastic part comprises a plurality of locking pawls which are connected to each other by plastic webs, which are integrally formed on them as a single piece, to form an entire ring of locking pawls and connecting webs. The plastic webs are designed with regard to their cross section and their material properties such that the entire ring can be expanded elastically until all of the locking pawls can be pressed outwards at the same time from their particular blocking position into their release position.

In a development of the invention, at least two locking pawls are provided on an annular locking ring, wherein the locking ring has an annular disk and locking pawl projections arranged perpendicularly with respect to the annular disk.

A plurality of locking pawls can thereby be arranged in the connecting subassembly by means of a single component. The locking pawls are designed, for example, as rectilinear, strip-like projections which extend vertically upwards from the inner circumference of the annular disk. In this case, the locking pawls are actuated by the outer circumference of the annular disk being deflected. On the other hand, the inner circumference of the annular disk is secured, and therefore, in conjunction with an elastic deformation of the annular disk, those ends of the locking pawls which are remote from the annular disk then move, for example outwards, in order to unblock the connecting subassembly.

In a development of the invention, the annular disk and the locking pawl projections are formed as a single piece from elastic material, in particular plastic.

The single-piece design of annular disk and locking pawl projections makes it possible to manufacture the annular locking ring in high piece numbers and at reasonable cost as a plastic injection-molded part. The annular disk, which is elastic at least in some sections, takes over the connection of the individual locking pawl projections to one another in this case and also makes it possible, by means of its elastic deformability, to deflect the locking pawl projections. At the same time, by use of an elastic annular disk, the locking pawl projections can also be prestressed into a position, for example the locking position.

Figure 1B:
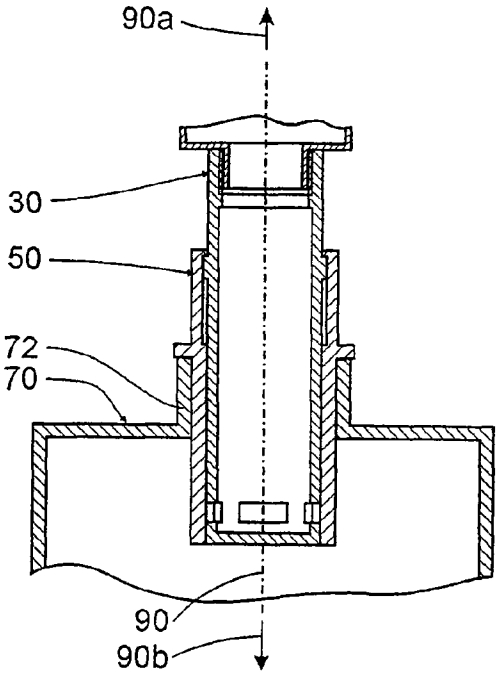
Figure 1C:
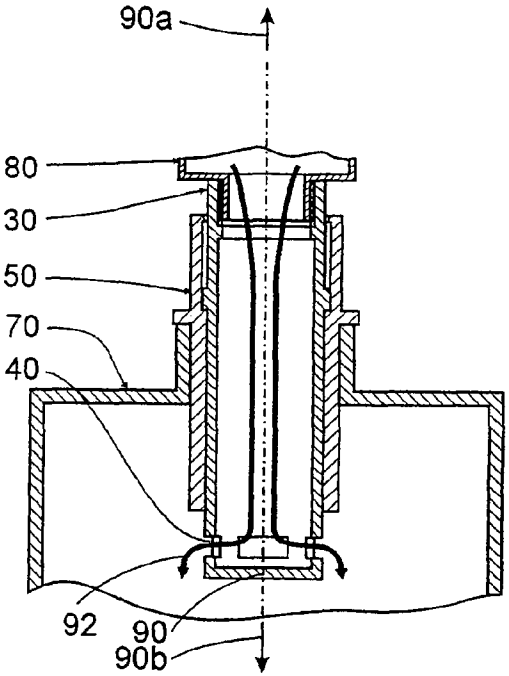
Figure 2A:
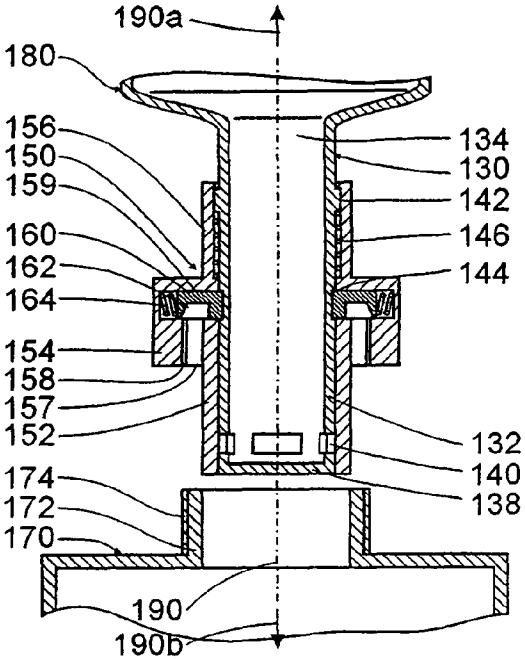
Figure 2B:
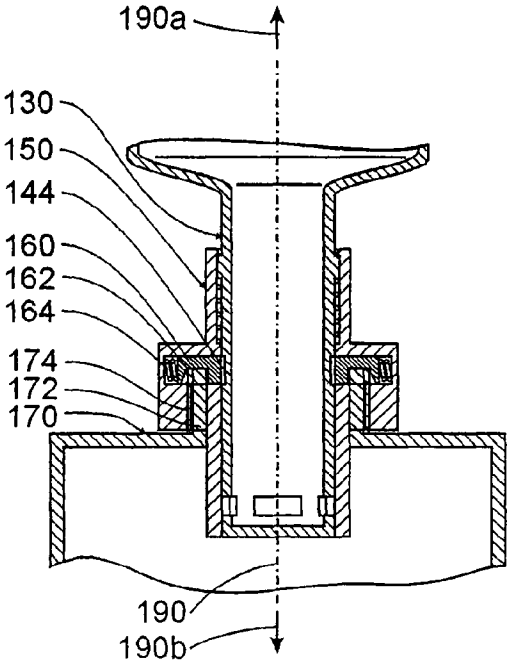
Figure 2C:
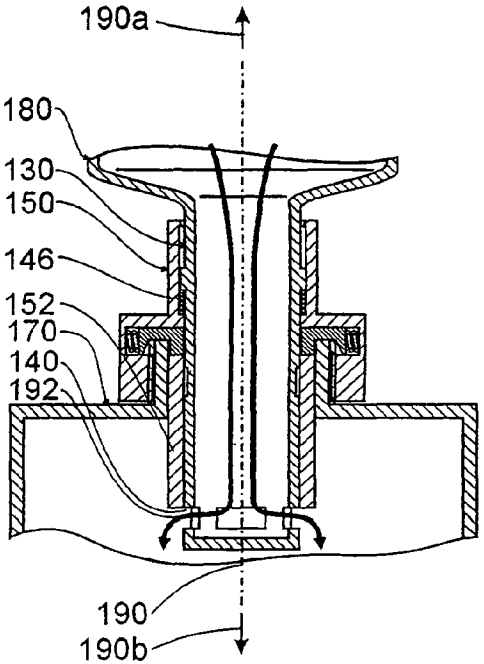
Figure 3C:
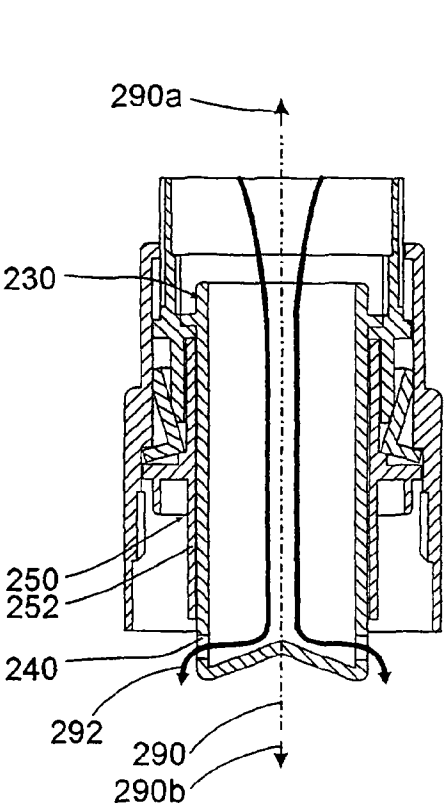
Figure 3B:
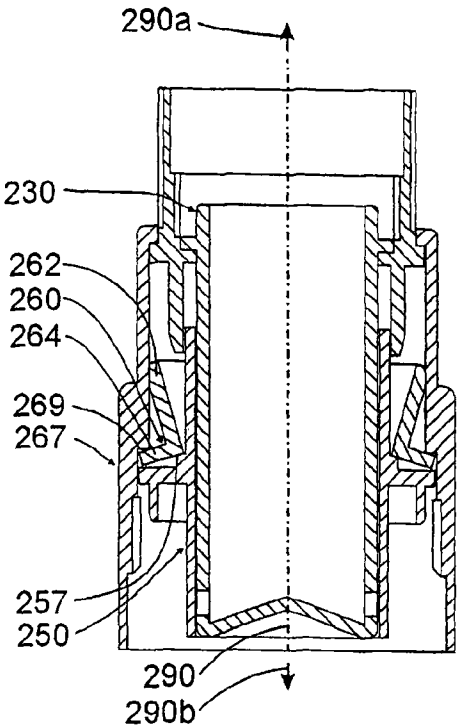
Figure 3A:
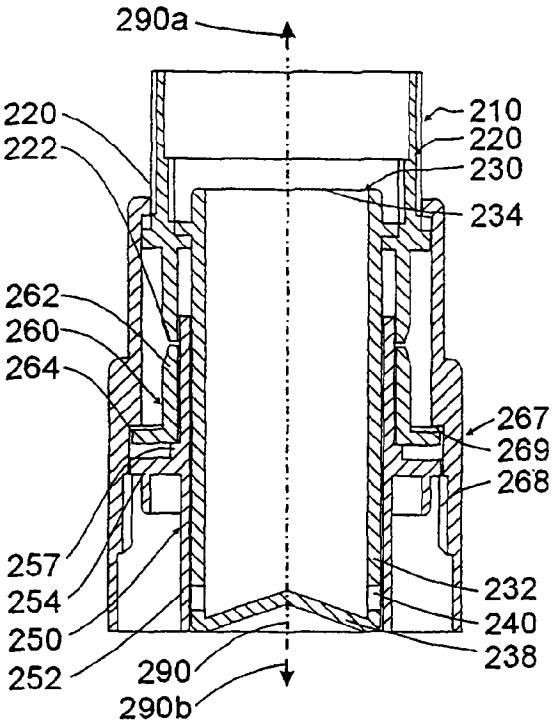
Figure 4:
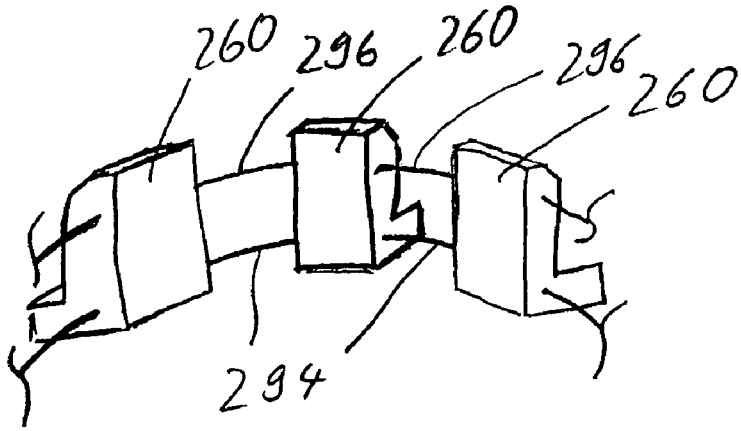
Figure 5:
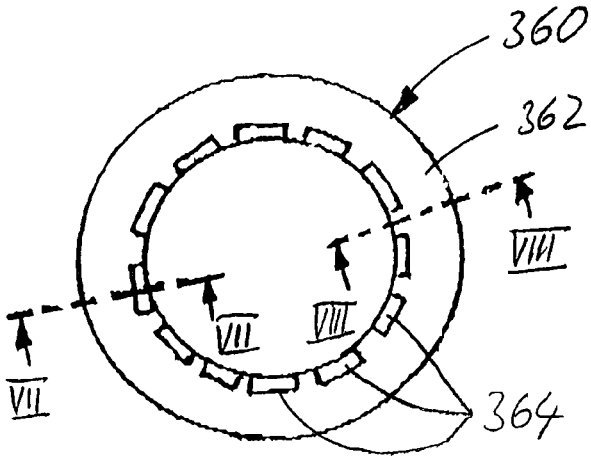
Figure 6:
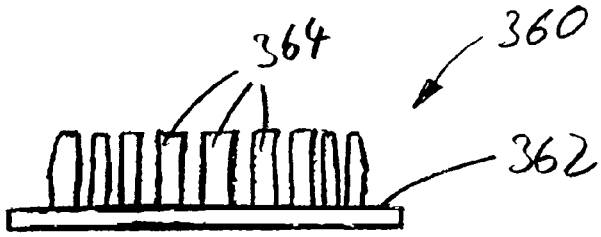
Figure 7:
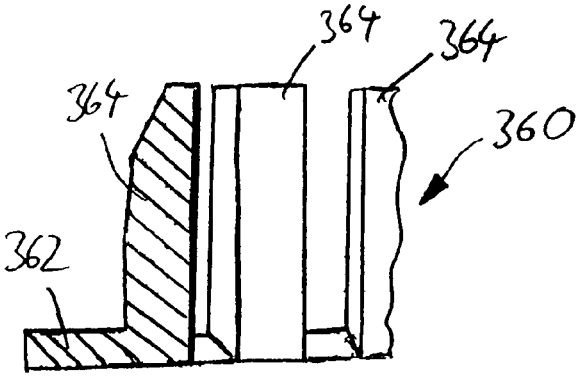
Figure 8:
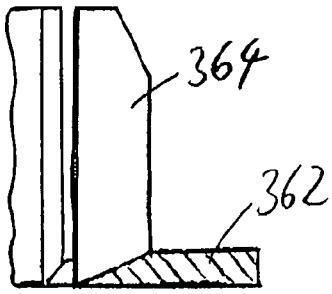
Figures 9A, 9B, 9C:
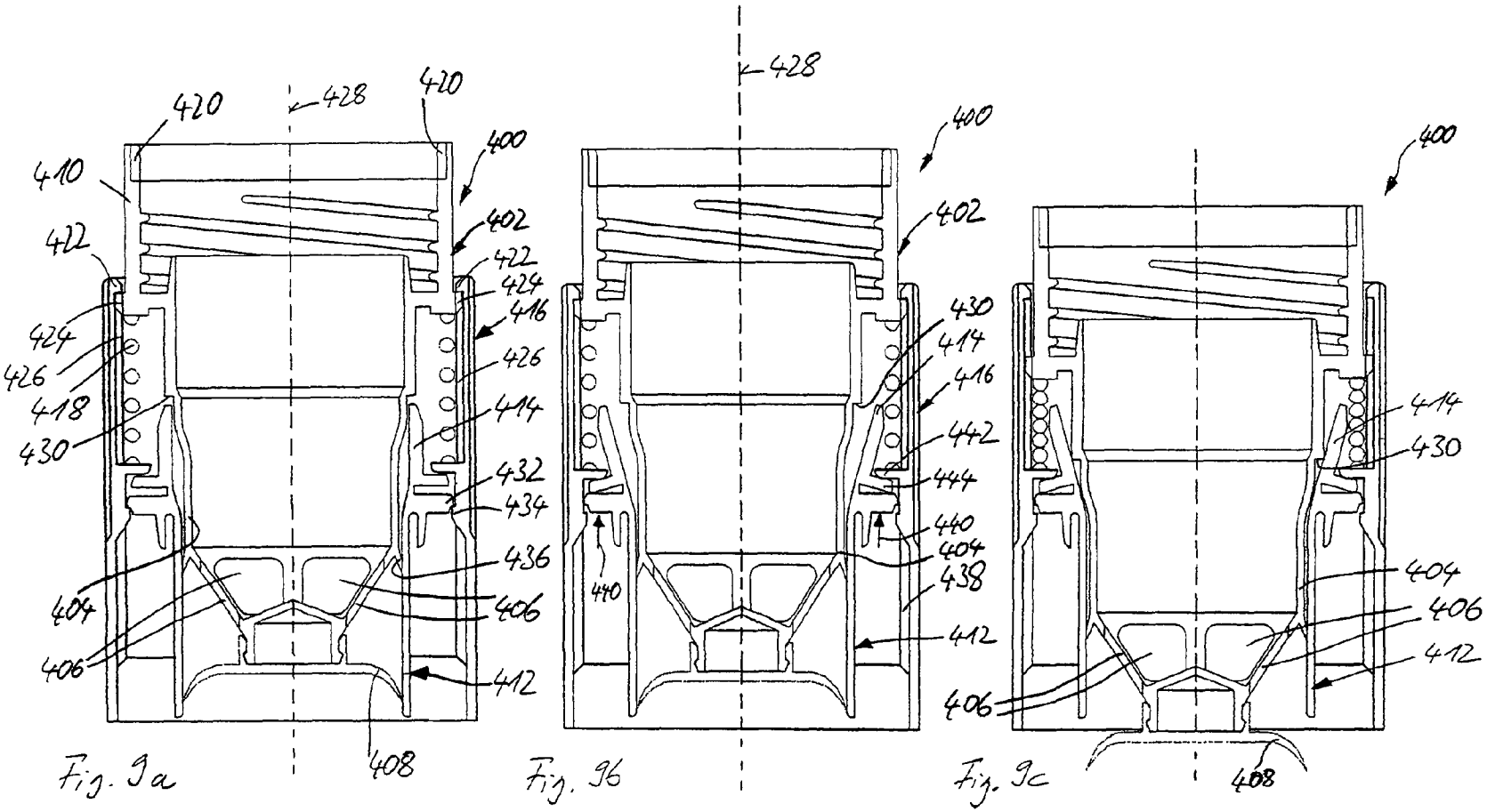
Figure 14:
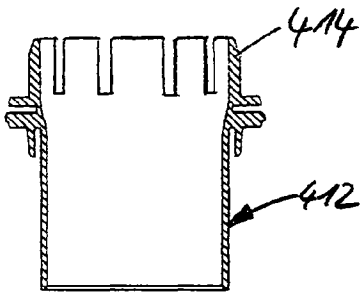
Figure 12:
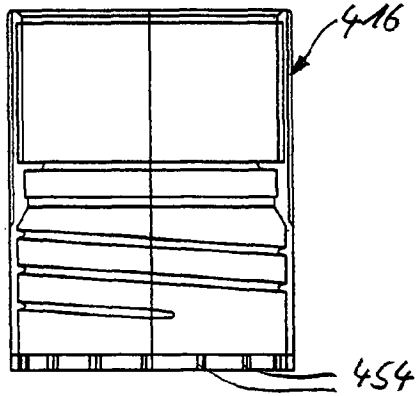
Figure 13:
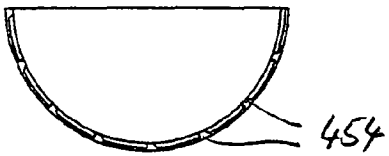
Figure 10:
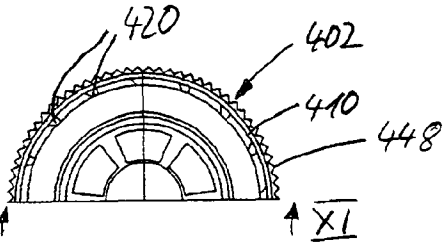
Figure 11:
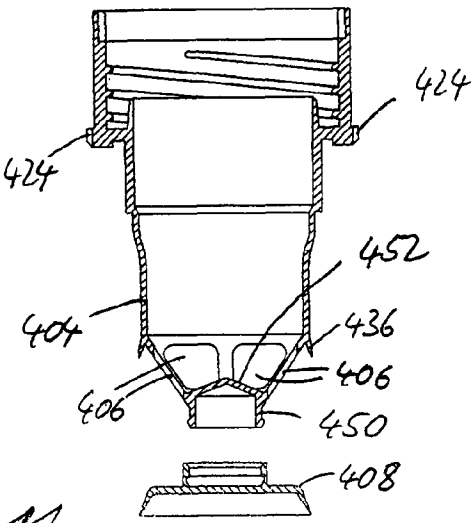
Figure 15:
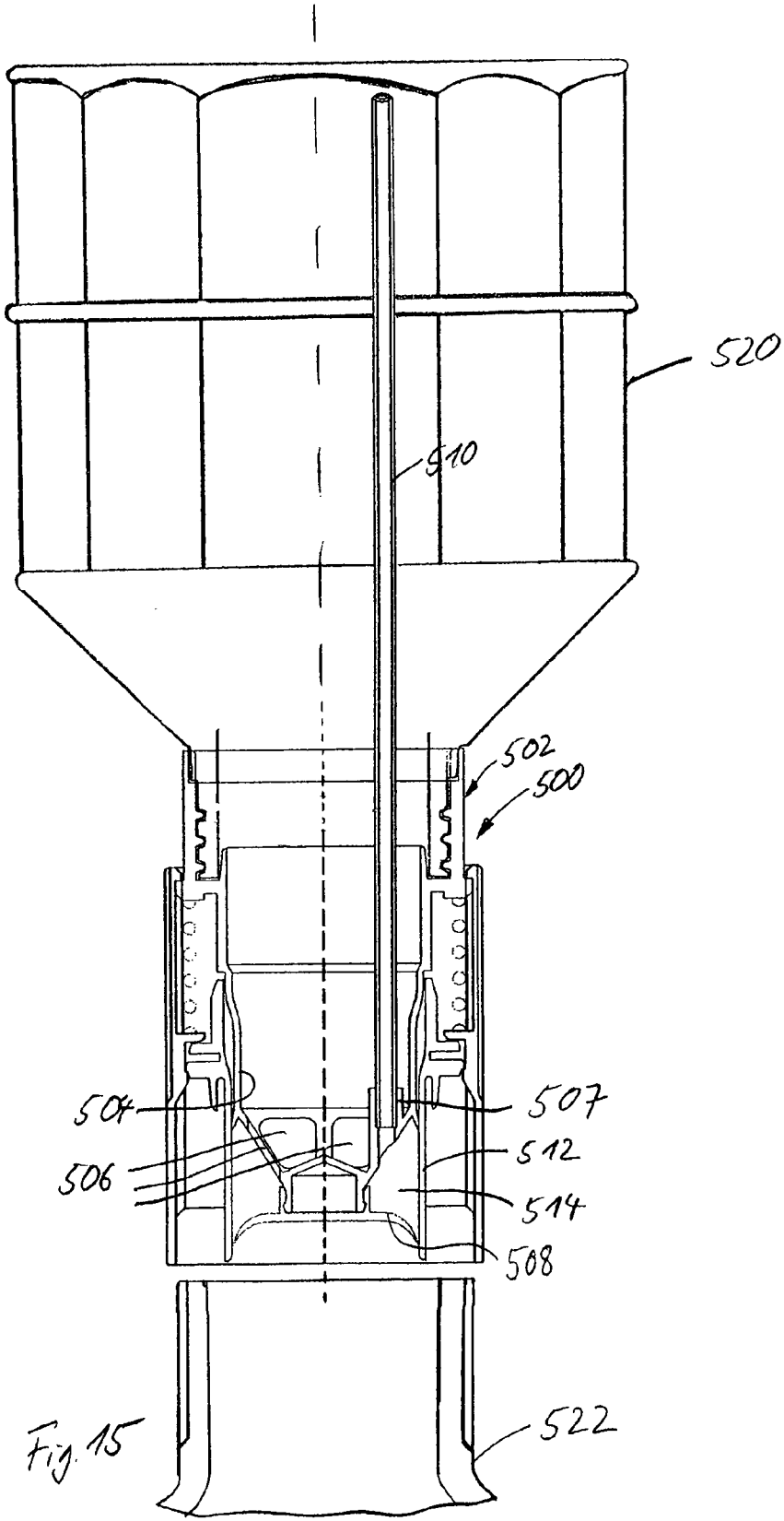
Figure 16:
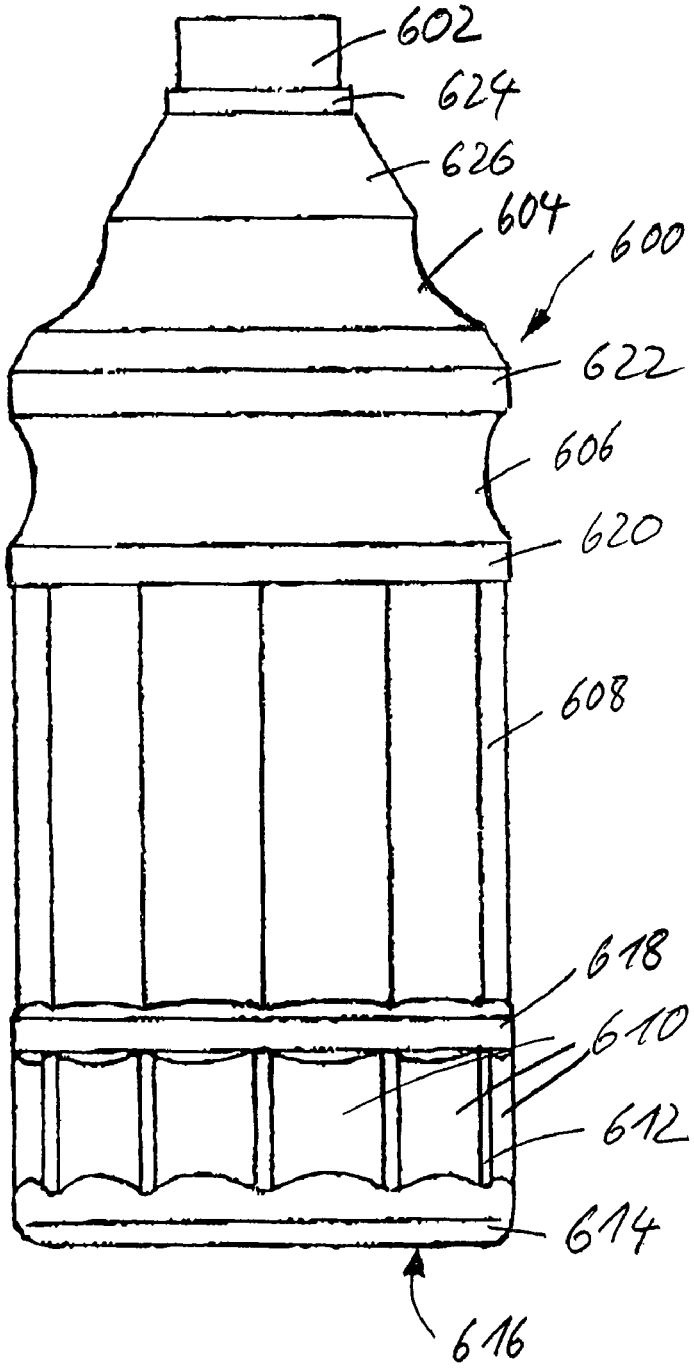
Figures 17A, 17B, 17C:
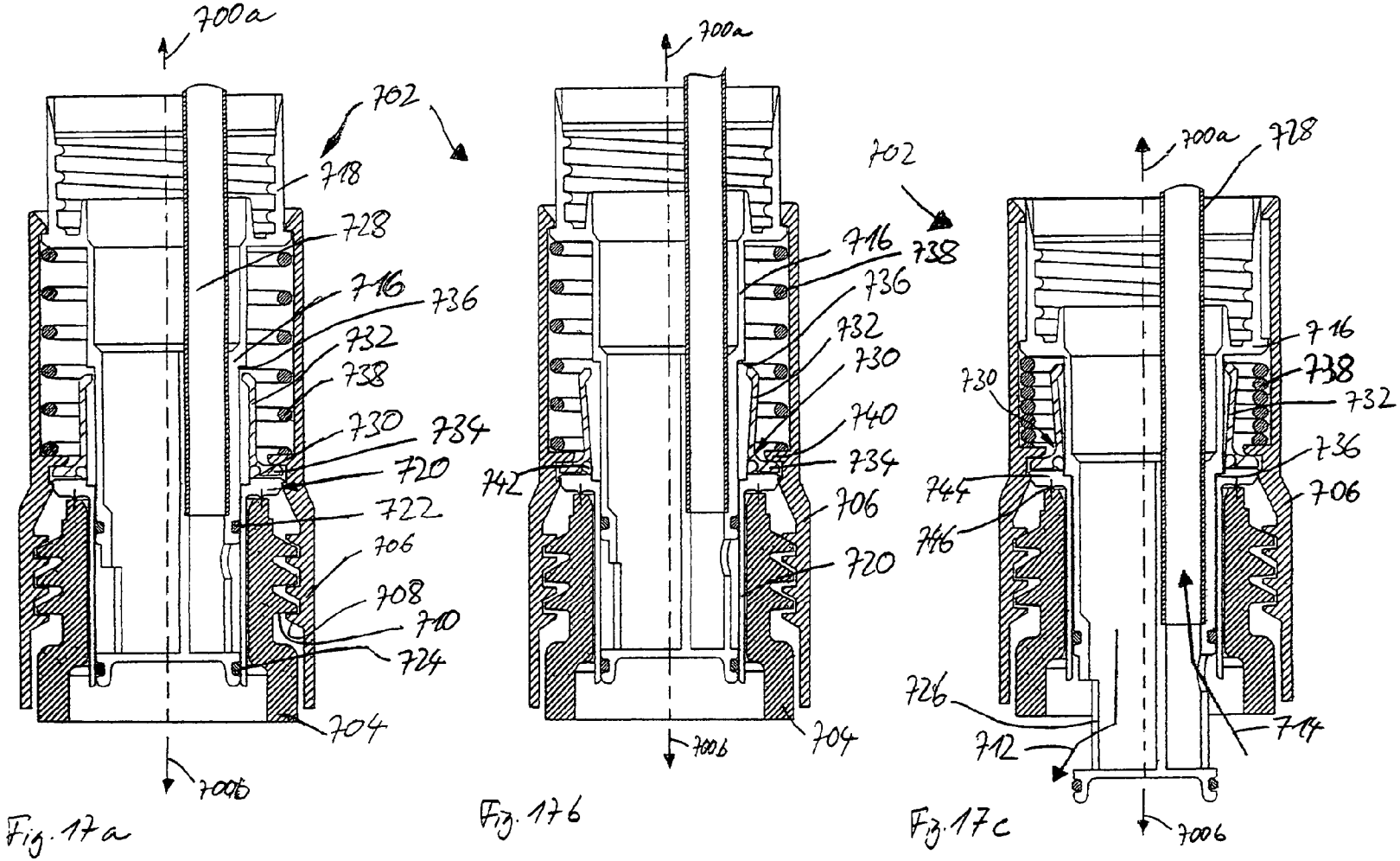

Further features of the invention emerge from the claims and the description in conjunction with the drawings. Three preferred embodiments of the invention are illustrated and described below. Individual features of the different embodiments can be combined in any desired manner without departing from the framework of the invention. In the drawings:

FIGS. 1*a*-1*c* show a first embodiment of a connecting subassembly according to the invention, in three stages of a filling operation, FIGS. 2*a*-2*c* show a second embodiment of a connecting subassembly according to the invention with locking pawls, in three stages of a filling operation, FIGS. 3*a*-3*c* show a third embodiment of a connecting subassembly according to the invention with locking pawls, in three stages of a filling operation, FIG. 4 shows a schematic illustration of some of the locking pawls of the third embodiment, FIG. 5 shows a plan view of a locking ring as can be used in a connecting subassembly according to FIGS. 3*a* to 3*c*, FIG. 6 shows a side view of the locking ring of FIG. 5, FIG. 7 shows a sectional view along the line VII-VII of FIG. 5, FIG. 8 shows a sectional view along the line VIII-VIII of FIG. 5, FIGS. 9*a*-9*c* show a fourth embodiment of a connecting subassembly according to the invention with locking pawls, in three stages of a filling operation, FIG. 10 shows a plan view of an outlet cylinder of the connecting subassembly of FIG. 9*a*, which outlet cylinder is halved in its center plane, FIG. 11 shows a view of the sectional plane XI-XI of FIG. 10, with a seal of the outlet cylinder being illustrated in the removed state, FIG. 12 shows a view of an outer sleeve of the connecting subassembly of FIG. 9*a* in the state in which it is cut open along a center plane, FIG. 13 shows a plan view of the outer sleeve of FIG. 12, cut open in the center, FIG. 14 shows a sectional view of a control cylinder of the connecting subassembly of FIG. 9*a* with locking pawls integrally formed on it as a single piece, FIG. 15 shows a sectional view of a fifth embodiment of a connecting subassembly according to the invention with a venting tube, FIG. 16 shows a side view of an initial container according to the invention and FIGS. 17*a*-17*c* show a sectional view of a sixth embodiment of a connecting subassembly according to the invention.

In conjunction with the description of the drawings, "up" refers to movements and orientations in direction 90*a*, 190*a*, 290*a*, 700*a* and "down" refers to movements and orientations in direction 90*b*, 190*b*, 290*b*, 700*b*.

FIGS. 1*a* to 1*c* show a first exemplary embodiment of a connecting subassembly according to the invention, and an initial media container 80 and a target media container 70. The connecting subassembly has an outlet cylinder 30 onto which a control cylinder 50 is pushed from below.

The outlet cylinder 30 is designed as a hollow cylinder with a circular cross section and has a tubular surface section 32. An upper end side 34 is of open design and has an internal thread 36, by means of which the outlet cylinder 30 can be connected to the initial media container 80, which has an external thread 82 matching the internal thread 36. The lower end side 38 of the outlet cylinder 30 is closed. A total of four output openings 40 are provided at the lower end of the surface section 32 and perforate the surface section 32.

The control cylinder 50 is likewise designed as a hollow cylinder with a circular cross section. The inside diameter of the control cylinder 50 corresponds, in a lower closing section 52, approximately to the outside diameter of the surface section 32 of the outlet cylinder 30, with a close clearance fit being used such that the outlet cylinder 30 and the control cylinder 50 can be displaced relative to each other in relation to each other in the direction of their respective main axis 90. Above the closing section 52, a collar section 54 is provided, the collar section encircling the closing section on the outside and being intended for resting on an extension piece 72 of the target container 70. A total of six latching lugs 56, which are latched over an encircling securing web 42 of the outlet cylinder 30, adjoin the collar section 54 above it. By means of the securing web 42 and the latching lugs 56, the outlet cylinder 30 and the control cylinder 50 are connected to each other in a manner such that they can be released and displaced relative to each other.

FIG. 1*a* shows the connecting subassembly before an operating position is reached. The connecting subassembly, comprising the outlet cylinder 30 and the control cylinder 50, is connected to the initial container 80. The control cylinder 50 is with respect to the outlet cylinder 30 in a closed position, in which the closing section 52 projects over the outlet openings 40 and thereby closes the latter.

FIG. 1*b* shows the connecting subassembly in the operating position. In this operating position, it is plugged together with the initial container onto the extension piece 72 of the target container 70. In the closed position, the control cylinder 50 is unchanged with respect to the outlet cylinder 30.

Starting from this closed position, the initial container 80 is displaced downwards together with the outlet cylinder 30 of the connecting subassembly until the open position, illustrated in FIG. 1*c*, is reached. In this open position, the outlet openings 40 are located below the lower edge of the control cylinder 50 and are thereby exposed. The medium located in the initial container 80 can therefore flow along the flow paths 92 through the outlet cylinder 30 into the target container 70.

It is particularly advantageous if the counterforce caused by the frictional resistance when pulling the connecting subassembly off from the target container 70 is greater at the contact surface between the control cylinder 50 and the extension piece 72 than between the control cylinder 50 and the outlet cylinder 30. The effect achieved by this is that a pulling-off force, which acts upwards on the initial container 80, first of all leads to the outlet cylinder 30 and the control cylinder 50 again being transferred into the closed position before the control cylinder 50 is detached from the extension piece 72. A specific transfer of the connecting subassembly into the closed position can be omitted as a result.

The described first embodiment of a connecting subassembly according to the invention enables the target container 70 to be filled without it being possible for medium to be lost. Even if the initial container 80 is not empty after the filling operation is completed, closure of the connecting subassembly before the initial container 80 and the connecting subassembly are removed from the target container 70 makes it possible to prevent medium from escaping.

FIGS. 2*a* to 2*c* show a second embodiment of a connecting subassembly according to the invention. Like the first embodiment which is illustrated in FIGS. 1*a* to 1*c*, this second embodiment also has an outlet cylinder 130, which has a tubular surface section 132 with four perforating outlet openings 140 at the lower end, an upper open end side 134 and a lower closed end side 138. An encircling securing web 142 and an encircling blocking groove 144 are provided on the outside of the surface section 132. In a departure from the first exemplary embodiment of FIGS. 1*a* to 1*c*, the outlet cylinder 130 is connected to an initial container 180 as a single piece.

A control cylinder 150 is pushed from below onto the outlet cylinder 130. This control cylinder 150 has a tubular closing section 152, the inside diameter of which forms a close clearance fit with the outside diameter of the surface section 132. Above the closing section 152, the control cylinder 150 has six latching lugs 156 by means of which the control cylinder 150 is fastened releasibly and displaceably to the encircling securing web 142 of the outlet cylinder 130. At the upper end of the closing section 152, the control cylinder 150 has a blocking section 154 with a relatively large diameter, in which a downwardly open, annular receiving groove 157 with an internal thread 158 is formed, the receiving groove serving to fasten the connecting subassembly to an extension piece 172 of a target container 170. A total of four recesses 159, which extend in the radial direction from the inside of the control cylinder and are intended for receiving locking pins 160 intersect the receiving groove 157 at the base of the groove.

A locking pin 160, which has a cutout with an angled wedged surface 162 on its lower side, is pushed into each of the recesses 159. The locking pins 160 can be displaced in the receptacles 159 in the radial direction, with a respective locking pin spring 164 being positioned at the outer end of the receptacles 159 and acting upon the locking pin 160 with a radially inwardly acting spring force.

A helical spring 164 is placed between the outlet cylinder 130 and the control cylinder 150, by means of which helical spring the outlet cylinder 130 is acted upon in relation to the control cylinder 150 by a spring force, which is directed upwards in the direction of the closed position, and the outlet cylinder is therefore prestressed into the closed position.

FIG. 2*a* shows the connecting subassembly, which is connected to the initial container 180 as a single piece, before the operating position on the extension piece 172 of the target container 170 is reached. In this state, the control cylinder 150 and the outlet cylinder 130 are relative to each other in a closed position, in which the closing section 152 of the control cylinder 150 lies above the outlet openings 140 of the outlet cylinder 130, thereby preventing the medium from escaping from the initial container 130. A displacement of the outlet cylinder 130 and of the control cylinder 150 before the operating position of FIG. 2*b* is reached is not possible, since, in this blocking position, the locking pins 160 project into the blocking groove 144 of the outlet cylinder 130.

Starting from the state of FIG. 2*a*, the connecting subassembly is screwed together with the initial container 130 onto the target container 170 by means of the internal thread 158 and an external thread 174 on the extension piece 172. During the screwing-on operation, an upper edge of the extension piece 172 presses against the wedge surface 162 of the locking pins 160 and, as a result, pushes them outwards counter to the spring force of the locking pin springs 164. The locking pins 160 thereby pass into the release position, which is illustrated in FIG. 2*b* and in which they are disengaged from the blocking groove 144 of the outlet cylinder 130.

In this operating position of the connection subassembly, the outlet cylinder 130 can be pressed from the closed position of FIGS. 2*a* and 2*b* into the opening position of FIG. 2*c*. For this purpose, the outlet cylinder 130 is pressed downwards together with the initial container 180 counter to the spring force of the helical spring 146, such that the outlet openings 140 are pushed out of the region of the closing section 152 of the control cylinder 150. When the state of FIG.

2*b* is reached, the medium located in the initial container 180 can flow through the outlet cylinder 130 along the flow path 192 into the target container 170.

As soon as the outlet cylinder 130 and the initial container 180 are no longer being pressed downwards, they shift upwards again on account of the spring force of the helical spring 146, and the outlet cylinder therefore passes again relative to the control cylinder 150 into the closed position and the flow of medium is interrupted. As soon as the control cylinder 150 is unscrewed again from the extension piece 172 of the target container 170, the locking pins 160 are inserted again by the locking pin springs 164 into the blocking groove 144 such that it is not possible for this closed position to be left outside the operating position of the connecting subassembly.

This second embodiment of FIGS. 2*a* to 2*c* is particularly secure on account of the locking pins, since only in the operating position do the latter permit a transfer into the open position and therefore an escape of the medium.

FIGS. 3*a* to 3*c* show a third embodiment of a connecting subassembly according to the invention.

In this third embodiment, the connecting subassembly has an outlet component 210, which comprises an attachment section 220 for fastening to an initial container, and an outlet cylinder 230 connected fixedly to said attachment section. Furthermore, the connecting subassembly has a control cylinder 250, seven locking pawls 260 connected to one another, and an outer sleeve 267.

The outlet cylinder 230 has a tubular surface section 232, which is perforated at the lower end by two outlet openings 240. An upper end side 234 of the outlet cylinder 230 is open and permits free flow of media into the outlet cylinder 230 when the latter is connected to the initial container. The opposite, lower end side 238 is closed.

The control cylinder 250 is pushed from below onto the outlet cylinder 230 and has a lower closing section 252, the inside diameter of which forms a close clearance fit with the outside diameter of the outlet cylinder 230, and which closing section covers the outlet openings 240 in a closed position of FIGS. 3*a* and 3*b*. Above the closing section 252, the control cylinder has an encircling collar section 254 which, in an operating position, rests on an extension piece of a target container. An encircling pivoting step 257 is provided on the upper side of the collar section.

An outer sleeve 267, which has an internal thread 268 for connecting the connecting subassembly to the target container, is pushed from above onto the outlet component 210 and the control cylinder 250. An encircling actuating step 269 is provided on the inside of the outer sleeve.

Between the outer sleeve 267 and the control cylinder 250, the seven locking pawls 260 are arranged annularly and uniformly spaced apart from one another. The locking pawls each have an L-shaped cross section with a blocking section 262 extending approximately in the axial direction 290, and with an actuating section 264 extending approximately radially. In a manner not illustrated, the locking pawls 260 are connected annularly to one another in the region of the blocking section 264 by elastic plastic webs. The spring force of the elastic plastic webs always presses the locking pawls 260 in the direction of the blocking position illustrated in the FIG. 3*a*. A helical spring can be arranged between an upper end of the control cylinder 250 and the flange of the attachment section 220, which flange extends inwards above this upper end, in order to produce prestressing into the blocking position illustrated.

FIG. 3*a* shows a state of the connecting subassembly before it is connected to the target container. In this state, the closing section 252 of the control cylinder 250 is situated above the outlet openings 240 of the outlet cylinder 230, and therefore medium cannot escape from the initial container (not illustrated), which is connected to the outlet cylinder 230. A manual displacement of the control cylinder 250 in relation to the outlet cylinder 230 is not possible, since the blocking sections 262 of the locking pawls 260 bear against the outlet cylinder 230 and prevent a displacement of the control cylinder 250 by bearing with their proximal end against the pivoting step 257 of the control cylinder 250 and with their distal end against an axially extending securing collar 222 of the outlet component 210 and thereby blocking a shortening of the distance between these components.

Starting from this state, the connecting subassembly is placed with the collar section 254 of the control cylinder 250 onto an extension piece (not illustrated) of a target container, and the outer sleeve 267 is firmly screwed to the extension piece by means of the internal thread 268. As illustrated in FIG. 3*b*, by this means, a relative displacement of the outer sleeve 267 in relation to the control cylinder 250 in direction 290*b* occurs and therefore also a displacement of the actuating step 269 of the outer cylinder 267 in relation to the pivoting step 257 of the control cylinder 250 occurs. Consequently, the actuating sections 264, which are situated inbetween, of the locking pawls 260 are tilted about a tangential axis, which, owing to the single-piece design, also has the consequence of a star-shaped tilting of the blocking sections 262 outwards counter to the spring force of the elastically stressed plastic webs and away from the securing collar 222. The tilted position of the locking pawls 260 that is illustrated in FIG. 3*b* constitutes a release position, in which a displacement of the outlet cylinder 230 in relation to the control cylinder 250 is possible.

FIG. 3*c* shows the connecting subassembly in its open position, in which the outlet cylinder 230 is pressed downwards in relation to the control cylinder 250, such that the outlet openings 240 are no longer covered by the closing section 252 of the control cylinder 250. The medium coming from the initial container (not illustrated) can flow through the outlet cylinder 230 along the flow path 292 into the target container (likewise not illustrated).

This third embodiment is advantageous in particular on account of the simple construction. The locking pawls 260 together with the connecting plastic webs form an single, annular component which is favorable to produce and simple to handle during installation. A schematic illustration of part of an annular component of this type is illustrated in FIG. 4. The individual locking pawls 260 are connected to one another by means of two plastic webs 294, 296 in each case. When the locking pawls 260 are tilted outwards, in particular the upper plastic webs 296 are subjected to an extension stress whereas the lower plastic webs 294 are located in the vicinity of the respective axis of rotation and are not subjected or are subjected to a lesser degree to an extension stress.

The plan view of FIG. 5 shows a locking ring 360 which can be used instead of the locking pawls 260 in the connecting subassembly of FIGS. 3*a* to 3*c*. The locking ring 360 has an annular disk 362 and a total of twelve locking pawl projections 364 arranged on the annular disk 362. The locking pawl projections 364 are arranged adjacent to an inner circumference of the annular disk 362 and thus spaced apart uniformly from one another along this inner circumference. The locking pawl projections 364 each have a rectangular cross section and extend from the annular disk 362 perpendicular with respect thereto.

As has already been mentioned, the locking ring 360 can be used instead of the locking pawls 260 in the device of FIGS. 3*a* to 3*c*. The inner circumference of the annular disk 362 is accordingly supported by means of a shoulder, and, when the connecting subassembly is screwed on, a force is exerted in the region of the outer circumference of the annular disk 362, downwards in FIG. 6. As a result, the annular disk 362 is elastically deformed, the inner circumference remains essentially at the same position, and the outer circumference is pressed downwards, in the illustration of FIG. 6. Since the locking pawl projections 364 are formed as a single piece with the annular disk 362, they are deflected outwards in the radial direction at their upper ends (in FIG. 6), which are not connected to the annular disk 362, by the deformation of the annular disk 362. As a result, the connecting subassembly can be unlocked.

Owing to the elastic deformation of the annular disk 362, the latter moves back again into its starting position (shown in FIG. 6) when the connecting subassembly is removed, and at the same time the upper ends of the locking pawls 364 also move back again into their locking position.

The sectional view of FIG. 7 along the line VII-VII of FIG. 5 shows a section through the locking ring at the location of a locking pawl projection 364. It can be seen that the annular disk 362 and the locking pawl projections 364 are designed as a single piece and are realized, for example, as a plastic injection-molded part. The inner circumference of the annular disk 362 is beveled in the intermediate spaces between two locking pawl projections 364. A lower side of the annular disk 362, which side lies opposite the locking pawl projections 364, then defines the smallest inner circumference of the locking ring 360 and, towards the upper side of the annular disk 362, the inner wall of the annular disk 362 then runs in a manner inclined outwards between two locking pawl projections 364. These measures make it possible to increase the mobility of the locking pawl projections 364, and advantages arise for the removal of the locking ring 360 from the mold.

The sectional illustration of FIG. 8 shows a sectional view along the line VIII-VIII of FIG. 5, and the beveled design of the inner circumference of the annular disk 362 can readily be seen here.

Overall, by means of the single-piece locking ring 360, a locking pawl component is provided which can also be produced cost-effectively in very high piece numbers and is extremely reliable and also readily withstands numerous operating cycles.

The sectional views of FIGS. 9*a*, 9*b* and 9*c* show a connecting subassembly 400 according to a fourth embodiment of the invention in three different stages of a filling operation. FIG. 9*a* shows a closed position, in which there is no flow connection from an initial container (not illustrated) to a target container (not illustrated) and through the connecting subassembly 400. FIG. 9*b* shows the connecting subassembly of FIG. 9*a* in an operating position, in which the connecting subassembly is already screwed onto the target container (not illustrated) and is thereby in an unlocked state. Finally, FIG. 9*c* shows an open position of the connecting subassembly 400, in which there is a flow connection between the initial container (not illustrated) and the target container (not illustrated) and through the connecting subassembly 400. The arrangement of the initial container and of the target container on the connecting subassembly 400 takes place in the same manner as described in conjunction with FIG. 15.

The connecting subassembly 400 of FIG. 9*a* has an outlet cylinder subassembly 402, which comprises the actual outlet cylinder 404 with a plurality of outlet openings 406, and a seal 408 and a connecting piece 410 for the initial container. Furthermore, a control cylinder 412 with locking pawls 414 integrally formed on it as a single piece, an outer sleeve 416 and a helical spring 418 between the outer sleeve 416 and the connecting piece 410 of the outlet cylinder subassembly 402 are provided. The helical spring 418 can be molded onto the outer sleeve 416 or the outlet cylinder subassembly 402 as a single piece. The connecting piece 410 is screwed to a matching external thread of the initial container (not illustrated), and there is therefore a flow connection between an interior space of the initial container and the outlet cylinder subassembly 402. The connecting piece 410 is provided above its internal thread turns with a plurality of latching cams 420, which are distributed over its inner circumference and can latch with matching latching cams of the initial container (not illustrated). After the connecting piece 410 is completely screwed onto the initial container, the connecting subassembly 400 and the initial container are then connected fixedly to each other in such a manner that the operation (still to be described below) of the connecting subassembly and especially the screwing thereof onto the target container and the movement thereof between an open position and a closed position can take place solely by movement of the initial container. The connecting subassembly 400 no longer has to be touched for this purpose. This is of great significance in particular in the event of poor accessibility, for example in the engine compartment of a motor vehicle.

Even after the connecting piece 410 is screwed onto the initial container, the connecting subassembly 400 remains in the closed state illustrated in FIG. 9*a*. Even if it were attempted to displace the outlet cylinder subassembly 402 relative to the outer sleeve 416, a displacement of this type would only be possible to a very small extent, but would not at any rate have any effect on the closed state of the connecting subassembly 400. In the illustration of FIG. 9*a*, a displacement of the outlet cylinder subassembly 402 upwards relative to the outer sleeve 416 is restricted by stops 422 against which outwardly projecting projections 424, which start from the connecting piece 410, strike. The projections 424 are guided in each case in longitudinal grooves 426 in the outer sleeve 416. The outlet cylinder subassembly 402 can therefore be displaced relative to the outer sleeve 416 only parallel to the center longitudinal axis 428. A displacement of the outlet cylinder subassembly 402 downwards is stopped by the encircling outer shoulder 430 of the outlet cylinder 404 stopping against the upper side of the locking pawls 414, which are L-shaped in cross section.

The locking pawls 414 are integrally formed as a single piece on the control cylinder 412 which, in turn, rests with an encircling outer shoulder 432 on projections 434 of the outer sleeve 416, which projections project inwards towards the control cylinder 412. As a result, a relative movement of the outlet cylinder 404 with respect to the control cylinder 412 is possible within vary narrow limits and does not at any rate lead to the release of a flow path from the initial container through the outlet openings 406 into the target container.

Even if the initial container is screwed onto the connecting piece 410 of the connecting subassembly 400, a medium can only pass out of the initial container through the outlet openings 406 into the control cylinder 412 and is then, however, retained by the seal 408, which bears with an encircling sealing lip against an inner wall of the control cylinder 412, in the annular space between the surface area of the outlet cylinder 404, in which the output openings 406 are provided, the seal 408 and the inner wall of the control cylinder 412. The liquid cannot escape from this annular space in the direction of the initial container either, since an encircling sealing lip 436 is integrally formed on the outlet cylinder 404 and prevents the medium from flowing back into the region between the outlet cylinder 404 and the outer sleeve 416.

In order to release a flow path from the initial container into the target container, the connecting subassembly 400 has first to be brought into the operating position illustrated in FIG. 9*b*. This takes place by the outer sleeve 416 being screwed onto the connecting piece of the target container (not illustrated). For this purpose, the outer sleeve 416 is provided in its lower region with an internal thread 438 which is screwed onto a corresponding external thread of a connection piece of the target container. As has already been mentioned, in order to screw the connecting subassembly 400 onto the connecting piece of the target container, the connecting subassembly 400 does not itself have to be rotated but rather this can take place by rotation of the initial container which is generally more readily accessible. Since the initial container is in any case retained in a substantially rotationally fixed manner in the connecting piece 410 of the outlet cylinder subassembly 402 by the latching cams 420 and the outlet cylinder subassembly 402 is arranged in a rotationally fixed manner on the outer sleeve 416, a rotation of the initial container about the center axis 428 causes the entire connecting subassembly 400 to rotate at the same time and, as a result, the internal thread 438 can be screwed onto an external thread of the target container.

After the outer sleeve 416 is completely screwed onto the connecting piece of the target container, the upper edge of the target container presses the control cylinder 412 upwards relative to the outer sleeve 416 at the locations indicated by means of the arrow 440. An encircling projection 442 on the outer sleeve 416, which projection projects into the interior of the outer sleeve 416, thereby presses onto the outwardly projecting bearing surfaces 444 of the locking pawls 414, as a result of which the locking pawls 414 are pivoted outwards and release the encircling outer shoulder 430 of the outlet cylinder 404. The outlet cylinder subassembly 402 can thereby be displaced downwards relative to the outer sleeve 416 and relative to the control cylinder 412 until the open position illustrated in FIG. 9*c* has been reached.

Upon displacement of the outlet cylinder subassembly 402 downwards relative to the outer sleeve 416, the control cylinder is secured relative to the outer sleeve 416, since the upper edge of the connecting flange of the target container presses the control cylinder 412 upwards at the points 440 against the projection 442 on the outer sleeve 416. The displacement of the outlet cylinder subassembly 402 downwards merely requires the exertion of a force on the initial container, which is connected to the connecting subassembly 400. As soon as the encircling edge of the seal 408, which edge bears on the inner wall of the control cylinder 412, leaves the control cylinder 412, a flow path is released between the initial container and the target container. Liquid or pourable medium from the initial container can then pass through the outlet cylinder 404 through the total of six outlet openings 406 having a large cross section and through the annular gap between the seal 408 and the lower edge of the control cylinder 412 into the target container. Owing to the large cross section of the outlet openings 406, an exchange of media can take place at a great speed.

The open position (illustrated in FIG. 9*c*) of the connecting subassembly 400 constitutes an end position, since, in this position, the outlet cylinder 404 strikes with its encircling outer shoulder 430 against the rear side of the locking pawls 414. Furthermore, a frustoconical outer surface of the outlet cylinder 404, which outer surface is arranged below the encircling outer shoulder 430, strikes against a likewise frustoconical inner surface of the control cylinder 412 and thereby prevents a further displacement of the outlet cylinder 404 downwards, in the illustration of FIG. 9*c*, relative to the control cylinder 412.

In order to interrupt the flow path between initial container and target container, all that is necessary is to pull the initial container in the direction away from the target container. Given an appropriate configuration of the helical spring 418, such a movement back takes place automatically, and therefore, in order to interrupt the flow path, the initial container merely has to be released or a compressive force in the direction of the target container reduced. After the initial container is completely moved back, the operating position (illustrated in FIG. 9*b*) of the connecting subassembly 400 is reached again, said operating position being maintained as long as the outer sleeve 416 is still screwed onto the connecting piece of the target container. After the connecting subassembly 400 is unscrewed from the connecting piece of the target container, the control cylinder 412 can then move downwards again relative to the outer sleeve 416 until its projection 432 strikes against the projection 434 of the outer sleeve 416 and the locking pawls 414 have moved back again into the locking position illustrated in FIG. 9*a*.

An emptying of the initial container is therefore possible only if the connecting subassembly 400 is screwed onto a target container. In the closed state illustrated in FIG. 9*a*, the numerous locking pawls 414, which are arranged in a ring shape, reliably prevent a flow path from being released through the connecting subassembly 400.

The illustration of FIG. 10 shows the plan view of an outlet cylinder subassembly 402 which is sectioned along a center plane XI-XI. A knurled portion 448, which is provided in the region of the connecting piece 410 and facilitates the screwing of the outlet cylinder subassembly 402 onto the connecting piece of an initial container, can readily be seen. The latching cams 420 on the inner circumference of the connecting piece 410, which latching cams, in the completely screwed-on state, latch with matching latching cams on the connecting piece of the initial container and thereby bring about antitwist protection of the outlet cylinder subassembly 402 on the initial container, can likewise readily be seen.

The outlet openings 406 are arranged on the outer surface of a section of the outlet cylinder 404, which section tapers conically in the direction of the target container, and provide a very large, free cross section for medium to be discharged.

The illustration of FIG. 11 shows a view of the sectioned outlet cylinder subassembly 402 of FIG. 10. The projections 424, which can be guided into matching guides of the outer sleeve 416 and ensure a rotationally fixed but axially displaceable arrangement of the outlet cylinder subassembly 402 in the outer sleeve 416, can readily be seen. Furthermore, the encircling sealing lip 436, which is integrally formed on the outer circumference of the outlet cylinder 404 at the transition between a cylindrical section and the frustoconical section with the outlet openings 406, can be readily seen. This frustoconical section with the outlet openings 406 is adjoined by a cylindrical section 450, onto which the seal 408 can be pushed by means of its matching piece and can be secured there. In the region of the frustoconical section, it can also be seen that a surface 452, which is opposed to the outflowing medium during the exchange of media between initial container and target container, is of conical design, and therefore the tip of this flat, conical surface 452 is opposed to the medium flowing out of the initial container and through the outlet cylinder 404. With the conical surface 452, good and, as far as possible, low-loss flow conditions can be ensured in the outlet cylinder 404, such that an exchange of media can take place at high speed.

The illustration of FIG. 12 shows an outer sleeve 416 half cut open. In addition to the illustration in FIGS. 9*a*, 9*b* and 9*c*, latching lugs 454 can be seen on the lower edge of the outer sleeve 416, which latching lugs project inwards from the inner circumference of the outer sleeve 416 and can engage with matching latching cams 454 on the connecting piece of a target container. The latching cams 454 can additionally ensure that the connecting subassembly 400 always sits fixedly on the target container such that there is no risk of the connecting subassembly 400 being inadvertently unscrewed again from the target container during the filling operation. The latching lugs 454 are expediently arranged in such a manner that only when the latching cams 454 of the outer sleeve 416 engage with matching mating latching cams on the target container are the locking pawls 414 pivoted according to FIG. 9*b* into the release position. The latching cams 454 and the arrangement thereof on the inner circumference of the outer sleeve 416 can also be seen in FIG. 13.

The illustration of FIG. 14 shows a sectional view of the control cylinder 412 with the locking pawls 414, which are molded onto the control cylinder 412 as a single piece.

The sectional view of FIG. 15 shows a fourth embodiment of a connecting subassembly 500 according to the invention. The connecting subassembly 500 is explained in detail only with reference to those parts which differ from the connecting subassembly 400 of FIGS. 9*a*, 9*b*, 9*c*. An outlet cylinder subassembly 502 is constructed identically per se and in itself to the outlet cylinder subassembly 402 of the connecting subassembly 400, only, in the frustoconical region with outlet openings 506, a tube connecting piece 507 is provided instead of one of the outlet openings. A venting tube 510 is pushed into the tube connecting piece 507 and produces a connection between an initial container 520 and the annular space 514 between outlet cylinder 504, seal 508 and inner wall of the control cylinder 512. The venting tube 510 projects into the interior space of the initial container 520 to an extent such that, in a state of the connecting subassembly 500 and the initial container 520 in which they are attached to a target container 522, said venting tube is located over a liquid level in the initial container 520. In the illustration of FIG. 15, the target container 522 is illustrated merely schematically and in part in the region of its connecting piece. During the exchange of media with the target container, the air displaced by the medium flowing into the target container 522 can thereby pass through the tube connecting piece 507 and the venting tube 510 into the initial container 520. Therefore, with the use of a connecting subassembly 500, a bidirectional exchange of media takes place by, namely, liquid or pourable medium passing out of the initial container 520 into the target container 522 and air displaced at the same time passing out of the target container 522 into the initial container 520. As a result, a system which is closed during the exchange of media can be realized for aggressive or toxic media.

As can be seen in the illustration of FIG. 15, the initial container 520 has a shape matched to the mounting conditions, with a frustoconical region adjoining its connecting piece. The generally cylindrical section of the initial container 520 that adjoins the frustoconical region is designed with a polygonal outer circumference in order to design the initial container 520 such that it can be grasped by an operator, and therefore, as has already been explained, the connecting subassembly 500 can be screwed onto the target container 522, opened and, after exchange of media has taken place, can also be unscrewed again from the target container 522 merely by handling the initial container 520.

The side view of FIG. 16 shows an initial container 600 according to the invention, which can be connected to one of the connecting subassemblies described above. For this purpose, a bottle thread 602 of the bottle 600 would be connected (in a manner not illustrated) to a connecting subassembly, for example to the outer sleeve thereof. In order to be able to readily handle the initial container 600 with the connecting subassembly screwed on, even in the case of very constricted space conditions, for example in the engine compartment of a motor vehicle, and especially in order to be able to set the different positions of the connecting subassembly merely by handling the bottle 600, the latter has two finger grooves 604 and 606, a main body 608, which is twelve-angled in cross section, and furthermore finger-gripping recesses 610. The finger-gripping recesses 610 are each designed as depressions which are in the shape of portions of a circular cylinder and extend with their longitudinal axis parallel to a longitudinal axis of the bottle 600. The plurality of finger-gripping recesses 610 are placed next to one another in a such a manner that in each case two finger-gripping recesses 610 are connected to each other by a web 612 running in the longitudinal direction of the bottle 600. All of the finger-gripping recesses 610 are distributed annularly around the outer circumference of the bottle 600 and are arranged directly above a standing ring 614 of the bottle 600, the bottle then merging into the bottle base 616. A first stiffening ring 618 is arranged between the finger-gripping recesses 610, which are arranged in ring form, and the main body 608, the stiffening ring imparting increased rigidity to the bottle 600, which is preferably produced from plastic. A further stiffening ring 620 is arranged between the main body 608 and the finger groove 606, and a third stiffening ring 622 is arranged between the two grooves 606 and 604. Following from the bottle thread 602, there is first of all a latching cam ring 624, which can ensure a fixed support in the connecting thread of a connecting subassembly. The latching cam ring 624 is adjoined by a region 626 which widens conically and then merges into the first finger groove 604. There is also a cross-sectional widening of the bottle 600 in the region of the first finger groove 604, and only in the region of the stiffening ring 622 is the largest diameter of the bottle 600 then achieved.

After a connecting subassembly is screwed onto the bottle thread 602, wherein also a seal of the bottle 600 can be automatically severed as the connecting subassembly is screwed on, the connecting subassembly, as has previously been described, is in a closed position. In order to bring the connecting subassembly with the initial container 600 screwed onto it into an operating position, the connecting subassembly has to be attached, for example screwed, to the connecting piece of a target container. This can take place merely by handling the initial container 600, namely by the operator's first hand engaging in one or both finger grooves 604, 606 and the operator's other hand engaging on the standing ring 614 and in at least one of the finger-gripping recesses 610. When the initial container 600 is rotated, the rotational movement is then applied to the hand acting on the finger-gripping recesses 610 and the fingers of the second hand can slide along in the grooves 604, 606. Already shortly after attachment to the target container, even a single-handed rotation of the connecting subassembly with the initial container 600 onto the target container can then take place. The connecting subassembly can then be brought, as has likewise already been described, into an open position and back again into the operating position by simple handling of the initial container 600 and, for example after complete emptying of the initial container, the latter can be unscrewed again together with the connecting subassembly from the target container.

The sectional views of FIGS. 17*a*, 17*b* and 17*c* show a connecting subassembly 702 according to the invention in various states in accordance with a sixth embodiment.

In the illustrations of FIGS. 17*a*, 17*b* and 17*c*, the connecting subassembly 702 is connected to a target container 704 by an outer sleeve 706 of the connecting subassembly 702 being screwed with an internal thread 708 onto a screw-type connecting piece 710 of the target container 704. The target container 704 is only partially illustrated here together with its screw-on connecting piece 710.

In the state of FIG. 17*a*, the connecting subassembly 702 is not yet completely screwed onto the target container 704 and is still in a locked closed position. According to the illustration of FIG. 17*b*, the connecting subassembly 702 is completely screwed onto the screw-on connecting piece 710 of the target container 704 and is in an operating position, in which, although the connecting subassembly still does not permit any media to flow through, it is already in the unlocked state. Finally, FIG. 17*c* shows an open position of the connecting subassembly 702, in which medium can flow according to an arrow 712 from the initial container (not illustrated) into the target container and conversely air can flow back according to the arrow 714 from the target container into the initial container.

It can be seen with reference to FIG. 17*a* that the connecting subassembly 702 has an outlet cylinder 716 which is provided as a single piece with a connecting part 718 with an internal thread with which the connecting subassembly 702 can be screwed onto a screw-on connecting piece (not illustrated) of an initial container. The connecting subassembly furthermore has a control cylinder 720, in which the outlet cylinder is displaceably guided and with respect to which the outlet cylinder is sealed in the closed position illustrated in FIG. 17*a* by means of two sealing rings 722 and 724. As can be seen with reference to FIGS. 17*a*, 17*b* and 17*c*, displacement of the outlet cylinder 716 downwards according to the arrow 700*b* when the outlet cylinder 720 is stationary causes the outlet openings 726 thereof to be released, and therefore medium can flow through the connecting subassembly 702 according to the arrow 712 and conversely air can flow back again into the initial container through the outlet openings 726 and a venting tube 728. The sealing rings 722, 724 ensure that even media which are highly likely to creep are reliably kept within the connecting subassembly 702 in the state illustrated in FIG. 17*a* and, in particular during the screwing onto the target container 704, still no medium emerges.

In the closed position illustrated in FIG. 17*a*, a movement of the outlet cylinder 716 relative to the control cylinder 720 is largely blocked by locking pawls 730 which have an L-shape cross section and each have a blocking limb 732 and an actuating limb 734. A plurality of locking pawls 730 are spaced apart uniformly from one another around the circumference of the circular cylindrical outlet cylinder 716. The locking pawls 730, of which there is a plurality, are held in the blocking position illustrated in FIG. 17*a*, for example by means of elastic webs (not illustrated) as are indicated in the schematic illustration of FIG. 4 by way of example with the reference numbers 294 and 296. Alternatively, the locking pawls 730 are connected to one another in the region of their actuating limbs 734 by means of a continuous ring as illustrated by way of example in FIGS. 5 and 6, for example.

It can be seen that, during a movement of the outlet cylinder 716 downwards, even after a short distance an encircling projection 736, which extends to the outside, of the outlet cylinder 716 runs onto a respective free, upper end of the blocking limbs 732 of the locking pawls 730. This blocks a movement of the outlet cylinder 716 relative to the control cylinder 720 downwards according to the arrow 700*b*.

In the reverse direction upwards, i.e. according to the arrow 700*a*, the outlet cylinder 716 is prestressed by means of the spring 738, wherein a movement upwards is blocked by an outwardly extending, encircling step of the connecting part 718 bearing against a likewise encircling, inwardly projecting projection of the outer sleeve 706. Before the connecting subassembly 702 is screwed on, it will accordingly remain in the closed position illustrated in FIG. 17*a* because of the prestressing of the spring 738 and also, because of the locking pawls 730 which are in the blocking position, it cannot be moved counter to the force of the spring 738 into the open position illustrated in FIG. 17*c*.

In the illustration of FIG. 17*b*, the outer sleeve 706 is fully screwed onto the screw-on connecting piece 710 of the target container 704, as a result of which an inwardly extending, encircling step of the outer sleeve 706, which step is situated above the actuating limbs 734 of the locking pawls 730, is moved downwards relative to the state of FIG. 17*a* and thereby comes into contact with the upper side of the actuating limb 734 and then presses this actuating limb 734 downwards by a certain amount. Since the locking pawls 730 in the region of the transition between actuating limb 734 and blocking limb 732 are mounted pivotably on an encircling bead 742 of the control cylinder 720, the blocking limbs 732 of the locking pawls 730 are thereby pivoted outwards. The free, inwardly bent ends of the blocking limbs 732 are thereby moved out of the path of movement of the encircling step 736 of the outlet cylinder 716, and therefore the latter can now be displaced downwards counter to the force of the spring 738.

The state finally reached after full displacement downwards corresponds to an open position and is illustrated in FIG. 17*c*. In this open position, the spring 738 is completely compressed and thereby blocks further movement of the outlet cylinder 716 downwards. It is to be stressed, however, that, in contrast to the embodiment illustrated in FIGS. 3*a* to 3*c*, the locking pawls 730 are moved completely out of the path of movement of the outlet cylinder 716, and therefore the outlet cylinder 716 and especially the encircling step 736 can be moved completely past the locking pawls 730. It can readily be seen that this is achieved by the inwardly bent, free ends of the actuating limb 732 of the locking pawls 730 and that, as a result, given an appropriate design of the outlet cylinder 716, very large opening paths can be obtained which can release very large through flow cross sections.

High through flow rates can also be achieved by the media exchange, provided according to the invention, between initial container and target container 704. The medium flowing according to the arrow 712 from the initial container into the target container is replaced by air flowing back at the same time according to the arrow 714. In order to ensure effective ventilation of the target container 704 during the filling operation, the venting tube 728 extends into the initial container to an extent such that its free end is already above the liquid level of the medium in the initial container at the beginning of the filling operation.

The helical spring 738 can be designed either as a steel component or else as a plastic component. This considerably facilitates the recycling of the connecting subassembly 702, since the latter, with the exception of the sealing rings 722 and 724, can thereby consist entirely of plastic, in particular the same plastic.

In the region of the outlet openings 726 in the outlet cylinder, a plurality of outlet openings 726 are distributed over the circumference of the outlet cylinder 716 in such a manner that the latter is open over an angular region of overall approximately 270°.

The control cylinder 720 has an outwardly extending, encircling flange 744 which, after the control cylinder has been placed onto the target container, comes to lie on the upper end of the screw-on connecting piece 710 and, as a result, defines an end position of the control cylinder 720 on the target container 704. In order to reliably seal off this encircling flange 744 and therefore, the connecting subassembly 702 from the target container 704, the encircling flange 744 is provided on its lower side, which faces the target container 704, with an encircling projection 746 which is triangular in cross section and rests with its point on the upper side of the screw-on connecting piece 710 of the target container 704. When the outer sleeve 706 is screwed onto the target container 704, this projection 746 is pressed flat and thereby ensures reliable sealing between connecting subassembly 702 and target container 704. Since the locking pawls 730 are only pivoted from their blocking position into the release position when a predefined, travel-dependent and force-dependent screwing distance is passed through, it is also ensured that this projection 746, which fulfils the function of a sealing ring, provides a reliable seal on the screw-on connecting piece 710.

The invention claimed is:

1. Connecting subassembly for connecting
an initial container and
a target container,
Comprising:
an outlet cylinder with a first end side which can be connected to the initial container, wherein the first end side is open or at least one opening of the outlet cylinder is arranged in the region of the first end side, the outlet cylinder including a second closed end side with at least one outlet opening in a surface area, and
a control cylinder surrounding the outlet cylinder in the region of the outlet opening,
wherein, in an operating position, in which the connecting subassembly is connected to the target container, the outlet cylinder and the control cylinder are designed for displacement with respect to each other between a closed position, in which the control cylinder interrupts a flow path through the outlet opening of the outlet cylinder, and an open position, in which the control cylinder releases the flow path through the outlet opening of the outlet cylinder, wherein at least one locking pawl locks the displaceability of the control cylinder relative to the outlet cylinder in a blocking position of the locking pawl, in order to lock the control cylinder and the outlet cylinder in the closed position, and wherein by connecting the connecting subassembly to an extension piece of the target container an actuation of the locking pawl is triggered by which the locking pawl is moved from the blocking position into a release position so that the outlet cylinder is displaceable with respect to the control cylinder.

2. Connecting subassembly according to claim 1, wherein the outlet cylinder and the initial container are formed as a single piece.

3. Connecting subassembly according to claim 1, wherein the outlet cylinder includes a plug-in, screw-type or bayonet-type fastening for connection to the initial container.

4. Connecting subassembly according to claim 1, wherein the connecting subassembly comprises a plug-in, screw-type or bayonet-type fastening for connecting to the target container.

5. Connecting subassembly according to claim 1, wherein in the operating position, the control cylinder is arranged in a fixed position relative to an extension piece of the target container.

6. Connecting subassembly according to claim 1, wherein the at least one outlet opening is arranged in such a manner that, in the operating position of the connecting subassembly and the open position of the control cylinder and of the outlet cylinder with respect to each other, the outlet opening is located within the target container.

7. Connecting subassembly according to claim 1, including a spring providing a spring force to maintain the control cylinder and the outlet cylinder in the closed position.

8. Connecting subassembly according to claim 1, wherein the at least one locking pawl is provided between the control cylinder and an outer sleeve, and wherein the outer sleeve, to fasten to the extension piece of the target container, is displaced relative to the control cylinder in such a manner that the locking pawl is tilted out of a blocking position into a release position.

9. Connecting subassembly according to claim 8, wherein the at least one locking pawl is of L-shaped design and comprises a blocking limb and an actuating limb, wherein a proximal end of the actuating limb rests on a pivoting step of the control cylinder and, in the release position, a distal end of the actuating limb bears against an actuating step of the outer sleeve.

10. Connecting subassembly according to claim 1, wherein the at least one locking pawl is acted upon in the direction of the blocking position by a spring force.

11. Connecting subassembly for connecting an initial container and a target container, comprising:
an outlet cylinder with a first end side which can be connected to the initial container, wherein the first end side is open or at least one opening of the outlet cylinder is arranged in the region of the first end side, the outlet cylinder including a second closed end side with at least one outlet opening in a surface area, and
a control cylinder surrounding the outlet cylinder in the region of the outlet opening,
wherein, in an operating position, in which the connecting subassembly is connected to the target container, the outlet cylinder and the control cylinder are designed for displacement with respect to each other between a closed position, in which the control cylinder interrupts a flow path through the outlet opening of the outlet cylinder, and an open position, in which the control cylinder releases the flow path through the outlet opening of the outlet cylinder, the connecting subassembly further comprising at least two locking pawls, by means of which the displaceability of the control cylinder relative to the outlet cylinder can be locked in a blocking position of the locking pawls, said locking pawls arranged on the outer circumference of the control cylinder and connected to each other by elastic intermediate elements oriented in the circumferential direction, and wherein said locking pawls are acted upon in the direction of the blocking position by a spring force.

12. Connecting subassembly according to claim 11, wherein the locking pawls are together formed as a single piece from plastic, and the intermediate elements comprise elastic plastic webs.

13. Connecting subassembly for connecting an initial container and a target container, comprising:
an outlet cylinder with a first end side which can be connected to the initial container, wherein the first end side is open or at least one opening of the outlet cylinder is arranged in the region of the first end side, the outlet cylinder including a second closed end side with at least one outlet opening in a surface area, and
a control cylinder surrounding the outlet cylinder in the region of the outlet opening,
wherein, in an operating position, in which the connecting subassembly is connected to the target container, the outlet cylinder and the control cylinder are designed for displacement with respect to each other between a closed position, in which the control cylinder interrupts a flow path through the outlet opening of the outlet cylinder, and an open position, in which the control cylinder releases the flow path through the outlet opening of the outlet cylinder, the connecting subassembly further comprising at least two locking pawls, by means of which the displaceability of the control cylinder relative to the outlet cylinder can be locked in a blocking position of the locking pawls, said locking pawls provided on an annular locking ring, wherein the locking ring has an annular disk and locking pawl projections arranged perpendicularly with respect to the annular disk, wherein said locking pawls are acted upon in the direction of the blocking position by a spring force.

14. Connecting subassembly according to claim 13, wherein the annular disk and the locking pawl projections are formed as a single piece from elastic material.

15. Connecting subassembly for connecting an initial container and a target container, comprising:

an outlet cylinder with a first end side which can be connected to the initial container, wherein the first end side is open or at least one opening of the outlet cylinder is arranged in the region of the first end side, the outlet cylinder including a second closed end side with at least one outlet opening in a surface area, and a control cylinder surrounding the outlet cylinder in the region of the outlet opening, wherein, in an operating position, in which the connecting subassembly is connected to the target container, the outlet cylinder and the control cylinder are designed for displacement with respect to each other between a closed position, in which the control cylinder interrupts a flow path through the outlet opening of the outlet cylinder, and an open position, in which the control cylinder releases the flow path through the outlet opening of the outlet cylinder, the connecting subassembly further comprising at least one locking pawl with which a relative displacement of the control cylinder and the outlet cylinder can be blocked in a blocking position of the locking pawl, wherein the at least one locking pawl is integrally formed on the control cylinder.

16. Connecting subassembly according to claim 15, said locking pawl comprising one of a plurality of locking pawls provided in an annular configuration and integrally formed on one end of the control cylinder as a single piece.

17. Connecting subassembly for connecting an initial container and a target container, comprising:

an outlet cylinder with a first end side which can be connected to the initial container, wherein the first end side is open or at least one opening of the outlet cylinder is arranged in the region of the first end side, the outlet cylinder including a second closed end side with at least one outlet opening in a surface area, and a control cylinder surrounding the outlet cylinder in the region of the outlet opening, wherein, in an operating position, in which the connecting subassembly is connected to the target container, the outlet cylinder and the control cylinder are designed for displacement with respect to each other between a closed position, in which the control cylinder interrupts a flow path through the outlet opening of the outlet cylinder, and an open position, in which the control cylinder releases the flow path through the outlet opening of the outlet cylinder, the connecting subassembly further comprising at least one locking pawl having a blocking limb, wherein a free end of the blocking limb can project into a path of movement of the control cylinder, and wherein the free end of the blocking limb is bent in the direction of the control cylinder.

18. Connecting subassembly according to claim 1, further comprising a venting tube which is connected in the region of the outlet openings to the outlet cylinder and an opposite end of the venting tube projecting into the initial container.

19. Connecting subassembly according to claim 1, wherein the outlet cylinder is held in a rotationally fixed and axially displaceable manner in an outer sleeve, and wherein the outer sleeve is capable of being screwed onto a connecting piece of a target container.

20. Connecting subassembly according to claim 1, wherein the outlet cylinder has an encircling sealing lip, which is integrally formed thereon as a single piece, for sealing the outlet cylinder with an inner wall of the control cylinder.

21. Connecting subassembly according to claim 1, wherein the second end side of the outlet cylinder having the at least one outlet opening, is provided with a plurality of the outlet openings and with a sealing plate having an encircling edge that, in the closed position, bears against an inner wall of the control cylinder.

* * * * *